US006726364B2

(12) United States Patent
Perell et al.

(10) Patent No.: US 6,726,364 B2
(45) Date of Patent: Apr. 27, 2004

(54) BUBBLE-SEAL APPARATUS FOR EASILY OPENING A SEALED PACKAGE

(75) Inventors: William S. Perell, San Francisco, CA (US); Neil S. Hayden, deceased, late of Franklin Lakes, NJ (US), by Ellen Hayden, legal representative

(73) Assignee: PopPack, LLC, San Francisco, CA (US)

( * ) Notice: Subject to any disclaimer, the term of this patent is extended or adjusted under 35 U.S.C. 154(b) by 51 days.

(21) Appl. No.: 10/246,893

(22) Filed: Sep. 19, 2002

(65) Prior Publication Data

US 2004/0057638 A1 Mar. 25, 2004

(51) Int. Cl.[7] ..... B65D 33/00
(52) U.S. Cl. ..... 383/210; 383/61.1
(58) Field of Search ..... 383/210, 211, 383/61.1, 3

(56) References Cited

U.S. PATENT DOCUMENTS 3,120,336 A * 2/1964 Whatley, Jr. ..... 383/210
3,419,137 A * 12/1968 Walck, III ..... 206/364
4,759,472 A * 7/1988 Strenger ..... 222/92
5,131,760 A * 7/1992 Farmer ..... 383/210
5,137,154 A * 8/1992 Cohen ..... 206/522

FOREIGN PATENT DOCUMENTS

GB 002253605 A * 9/1992 ..... 383/210

* cited by examiner

*Primary Examiner*—Jes F. Pascua
(74) *Attorney, Agent, or Firm*—Paul Hentzel

(57) ABSTRACT

An easily opened storage package 10 has enclosure material 10M forming storage chamber 10C within the package containing stored article 10A. Chamber access region 12A proximate edge 12E of the package, provides entrance into the chamber and access to the stored article. Band seal 14 formed by upper lamina 14U and lower lamina 14L extends along the access region, enclosing breaching bubble 16. The band seal has inner seal portion 14I between the bubble and the chamber, and outer seal portion 14O between the bubble and edge 12E of the package. The bubble is expandable to open the package by external pressure applied by a consumer. Opposed pair of peel flaps, upper flap 16U and lower flap 16L, are formed by the opposed laminae of the outer seal along the edge breach as the bubble breaches. These small initial flaps are grasped by the consumer and manually peeled apart to initiate opening the band seal.

35 Claims, 2 Drawing Sheets

BUBBLE-SEAL APPARATUS FOR EASILY OPENING A SEALED PACKAGE

TECHNICAL FIELD

This invention relates to a sealed package having a bubble-seal for easy opening, and more particularly to bubbles which are edge breached to provide peel flaps for opening the package.

BACKGROUND

In earlier times small packages of consumer goods such as snacks and candy bars were easy to open. The goods were wrapped in paper, light plastic, thin cellophane, or some other easy to tear closure material. These packages frequently had pull tabs or rip strings to assist the consumer. Some items were simply cradled in a folded tinfoil wrapper which slid out of a paper sleeve. Later, cost pressure and safety considerations drove the packaging industry toward today's difficult to open containers. Stronger enclosures reduced shipping and storage spoilage and retail handling losses. Thicker, tougher material was employed to minimize accidental and intentional puncturing. The enclosures became sterile, hermetically sealed cells to protect against moisture damage. In certain cases, tamper resistant features further hindered the easy opening of the packages. Pull tabs were no longer provided and the consumer frequently had to resort to scissors or a blade to open the package. The modern, shrink-wrap packaging of small consumer goods may present the ultimate challenge to the consumer.

U.S. Pat. No. 4,872,556 to Farmer shows a package with a bursting seal for controlling the discharge rate of a stored liquid or fluid commodity. The commodity is contained in a large storage chamber and dispensed through a smaller, adjacent discharge chamber. Pressure applied to the commodity in the storage chamber causes a storage seal between the two chambers to rupture, resulting in fluid flow from the storage chamber into the discharge chamber. Continued pressure on the storage chamber fluid causes a discharge seal to rupture permitting the fluid to discharge from the discharge chamber into the environment. The Farmer package and technique was not suitable for solid commodities. Major applied pressure was required to rupture both the storage seal and the discharge seal. This pressure is the only force at work to burst the package, and simultaneously ruptures the seals and discharges the liquid. The force is increased by the consumer until the commodity is discharged. The internal pressure in the chambers, may cause fluid leakage through existing small cracks and other flaws. The pressure may contribute to the development of additional flaws at weak places in the closure material. A sufficiently heavy pressure directly on the fluid commodity will cause a sudden failure of the seals and an explosive, squirt release of the contents.

SUMMARY

It is therefore an object of this invention to provide a bubble-seal apparatus for a package which permits easy opening by a consumer. The package has a bubble-seal formed by one or more bubbles along the edge to be opened. The bubble or bubbles are edge breached by the consumer to create the start of an opening in the package. The package material around the bubble site after the edge breach, provides small peel flaps which the consumer may grasp to peel the package open.

It is another object of this invention to provide such a bubble-seal which permits the consumer to manually open a tough, hermetically sealed package using only his fingers without tearing the closure material or employing a separate tool or appliance. The consumer grasps the small peel flaps between his finger tips to start the peeling. As the peeling proceeds the peel flaps become larger. The consumer may hold them securely between his thumb and forefinger and peel with greater force. This manually opening effort may be conveniently executed at any time or place without the assistance of any external tools or aides.

It is a further object of this invention to provide such a bubble-seal which may be easily breached by the application of light pressure on a single bubbles or small groups of adjacent bubbles. This methodical, localized popping promotes a sequential opening process. Because the bubble squeezing requirement is slight, the arthritic elderly and young children may readily open the package. Further, the pressure is applied to the bubbles, not directly on the article in the package.

It is a further object of this invention to provide such a bubble-seal which permits a consumer to open a package without employing a sharp instrument or cutting edge. As part of increased homeland security, the security staff at airport checkpoints are screening passengers and X-raying luggage more closely. Small pocket scissors, penknives, and even fingernail clippers maybe detected and seized, possibly initiating a complete luggage search. This time-consuming security action may embarrass the suspect passenger, and delay the boarding of the other passengers. In addition, sharp instruments may be hazardous to a small child or elderly person (or anyone else) who might be opening a tightly sealed snack.

It is a further object of this invention to provide such a bubble-seal for an easily opened package which provides audio feedback during the opening process. The beaching bubbles provide an intense rush of escaping air with a popping sound much like the sound of a small balloon popping. This distinct sound informs the consumer that the immediate bubble has been properly popped. The consumer may then move on to the next bubble in an orderly, efficient manner.

It is a further object of this invention to provide such a bubble-seal for an easily opened package which provides tactile feedback during the opening process. The position of the bubbles may be readily sensed by the seeing impaired, or a child in a dark theater, or a night nurse on a dimly lighted ward. In addition, shape of the bubble may provide critical information about the article.

Briefly, these and other objects of the present invention are accomplished by providing a bubble seal apparatus for easily opening a storage package. Enclosure material forms a chamber within the package for containing a stored article, with a chamber access region proximate the edge of the package. A band seal extending along the access region is formed by opposed laminae of enclosure material pressed into sealing engagement. At least one breaching bubble within the band seal is enclosed between the opposed laminae. The opposed laminae form an inner seal within the band seal between the bubble and the chamber. The opposed laminae also form an outer seal within the band seal between the bubble and the edge of the apparatus. The breaching bubble is expandable towards the edge of the apparatus by applied pressure which separates the opposed laminae. When the bubble reaches the edge, the bubble breaches creating an edge breach in the outer seal. Opposed peel flaps are formed by the opposed laminae of the outer seal along the edge breach as the bubble breaches. These flaps are peeled apart separating the opposed laminae to open the band seal.

BRIEF DESCRIPTION OF THE DRAWINGS

Further objects and advantages of the package opening apparatus and the bubble-seal opening thereof will become apparent from the following detailed description and drawings (not drawn to scale) in which.

Figure 1A:
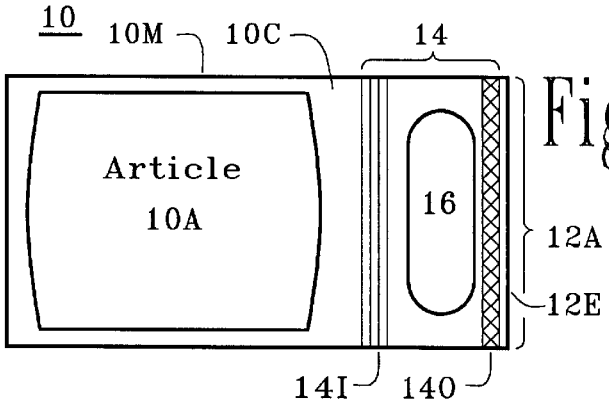
FIG. 1A is a side view of bubble-sealed storage package 10 showing stored article 10A and breaching bubble 16.
Figure 1B:
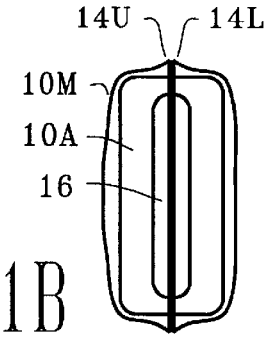
FIG. 1B is a end view of package 10 of FIG. 1A.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

| | | |
|---|---|---|
| 10 | Storage Package 10 | |
| | 10A | Stored Article 10A |
| | 10C | Storage Chamber 10C |
| | 10M | Enclosure Material 10M |
| | 12A | Chamber Access Region 12A |
| | 12E | Package Edge 12E |
| 14 | Band Seal 14 | |
| | 14I | Inner Seal Portion 14I |
| | 14L | Lower Lamina 14L |
| | 14O | Outer Seal Portion 14O |
| | 14U | Upper Lamina 14U |
| 16 | Breaching Bubble 16 | |
| | 16B | Edge Breach 16B |
| | 16F | Separation Frontier 16F |
| | 16L | Lower Peel Flap 16L |
| | 16U | Upper Peel Flap 16U |
| 20 | Storage Package 20 | |
| | 22E | Package Edge 22E |
| 26 | Adjacent Bubbles 26 | |
| | 26B | Expanded Edge Breach 26B |
| 30 | Storage Package 30 | |
| | 30C | Storage Chamber 30C |
| | 34R | First opening Site 34R |
| | 34L | Second Opening Site 34L |
| | 36R | Right Bubble Array 36R |
| | 36L | Left Bubble Array 36L |

-continued

| | | |
|---|---|---|
| 46 | Bubble Array 46 | |
| | 56A | Arrow Bubble 56A |
| | 56T | Texture Bubble 56R |
| | 56S | Square Bubble 56S |
| | 64I | Inner Seal Portion 64I |
| | 64S | Inward Expansion Stop 64S |

General Embodiment—(FIG. 1A–H)

An easily opened container or storage package 10 has enclosure material 10M forming storage chamber 10C within the package for containing stored article 10A. The enclosure material may be any suitable confining substance such as plastic, paper (with wood and/or cotton content) fabric, cellophane, or biodegradable matter. Thin mylar plastic forms a flexible film with hermetic properties, and is commonly used as a packaging material. Article 10A may be any tangible object (or objects) suitable for storage such as snacks, prepared foods, edibles generally, pharmaceuticals, manufactured products, agricultural commodities, or various household goods.

Chamber access region 12A proximate edge 12E of the package, provides entrance into the chamber and access to the stored article. Band seal 14 extends along the access region and is formed by opposed enclosure material. The band seal has upper lamina 14U and lower lamina 14L pressed into a sealing engagement. Breaching bubble 16 is enclosed between the opposed laminae within the band seal. The band seal has inner seal portion 14I and outer seal portion 14O, both formed by opposed laminae material. The inner seal portion is between the bubble and the chamber. The outer seal portion is between the bubble and edge 12E of the package.

Opening the Package

The bubble is expandable to open the package by external pressure applied by a consumer. For small bubbles, the consumer may simply pinch a bubble or bubbles between his thumb and forefinger. Slightly larger bubbles may require thumb-to-thumb pressure. The very young and older, infirm consumers may push downward on the bubble against a flat surface with a smooth aide such as a spoon. The consumer may direct the bubble expansion outward towards edge 12E of the package by applying the pressure along the inward side of the bubble proximate point "X" (see FIG. 1C). Inward expansion of the bubble is limited because the applied pressure keeps the opposed laminae pressed together in sealing engagement along the inward side. Therefore, expansion due to the directed pressure is primarily outward urging the bubble outward towards the edge of the package, as indicated by the large outward arrow. The outward bubble expansion progressively separates the opposed laminae forming the outer seal, along a moving separation frontier 16F. The frontier moves across the outer seal until the frontier reaches the edge of the package, where the bubble breaches creating edge breach 16B (see FIG. 1E and FIG. 1F).

Opposed pair of peel flaps, upper flap 16U and lower flap 16L, are formed by the opposed laminae of the outer seal along the edge breach as the bubble breaches. These small initial flaps are grasped by the consumer and manually peeled apart further separating the opposed laminae in order to initiate opening the band seal. The flaps are not pre-existing. They are not pull tabs fabricated during the manufacturing or packaging process. The flaps are created as the consumer expands and breaches the bubble in order open the package.

Flap Stretching

The opposed lamina material forming the bubble and the outer seal may stretch slightly under the applied pressure and bubble expansion. A stretching plastic type enclosure material such as mylar provides loose or baggy initial peel flaps (see FIG. 1F). The looseness offers the consumer more gripping material to start peeling the flaps apart.

Flap Enlarging

Figure 1C:
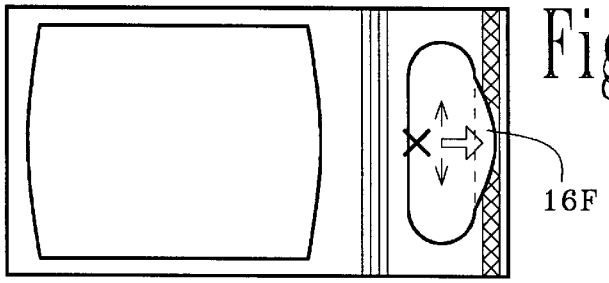
FIG. 1C is a side view of package 10 showing bubble 16 expanding under applied pressure at point "X"
Figure 1D:
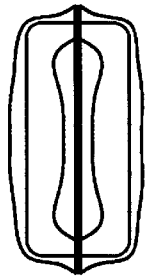
FIG. 1D is a end view of package 10 of FIG. 1C.
Figure 1E:
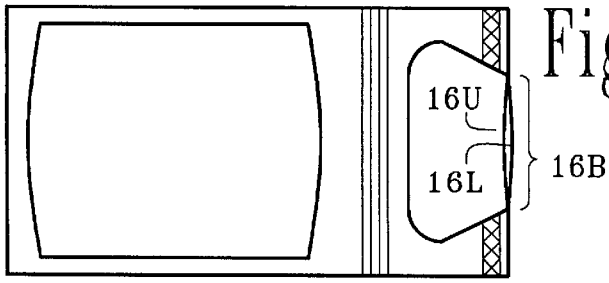
FIG. 1E is a side view of package 10 showing bubble 16 forming edge breach 16B.
Figure 1F:
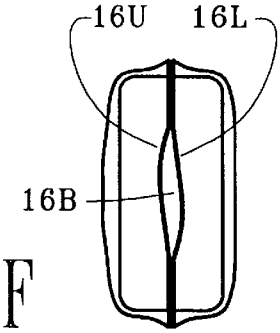
FIG. 1F is a end view of package 10 of FIG. 1E.
Figure 1G:
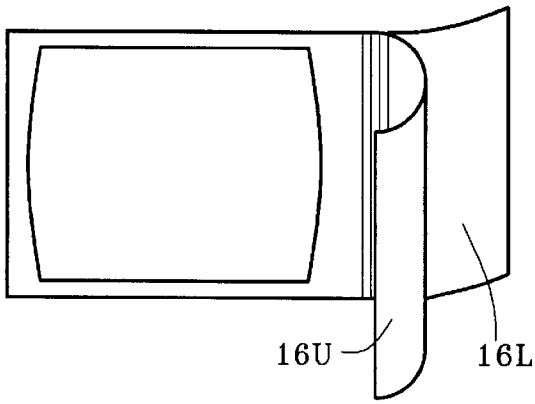
FIG. 1G is a side view of package 10 showing peel flaps 16U and 16L being peeled back to open chamber 10C.
Figure 1H:
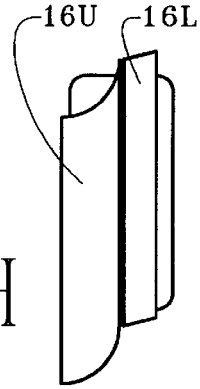
FIG. 1H is a end view of package 10 of FIG. 1G.

The initial peel flaps formed along the edge breach become larger in area as the consumer peels the flaps apart (see FIG. 1G and FIG. 1H). This enlarged area first includes some of the opposed lamina material forming the outer seal. As the flaps are peeled further apart, the enlargement includes some of the opposed lamina material forming the bubble, and then some of the material forming the inner seal. This enlarged flap area offers the consumer an even more material to grip as the laminae separation proceeds. The uniform, page-like peeling shown in FIG. 1G illustrates ideal separation of the laminae. The actual peeling may be uneven, irregular, or askew. The opposed lamina material forming the inner seal may be resealable to permit resealing the chamber after the band seal has been opened. The resealing may be established by groove and flange engaging structure along the opposed laminae which are pinched back into sealing engagement by the consumer.

Figure 6:
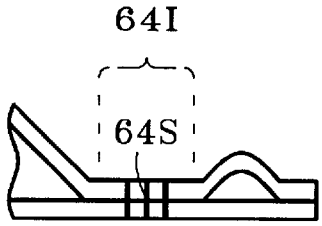
FIG. 6 is a fragmentary view of inner seal portion 64I showing inward expansion stop 64S.

The bubble expands under the applied pressure both outward towards edge 12E of the apparatus and laterally, as indicated by the small lateral arrows (see FIG. 1C). The lateral expansion provides a laterally expanded edge breach with laterally expanded peel flaps. Instead of the directed pressure shown in FIG. 1C, the consumer may press closer to the center of the bubble, causing the bubble to expand in all directions. The bubble may expand under the applied pressure both outward towards the edge of the apparatus and inward towards the inner seal. Inward expansion increases the area of the flaps, which may infringe on the inner seal causing partial preopening. Inward expansion stop 64S formed in inner seal portion 64I (see FIG. 6) may be provided to hinder inward expansion of the bubble towards the inner seal portion. The stop directs all (or at least most) of the bubble expansion outward towards the edge of the apparatus. The stop may be established by employing thicker or stiffer lamina along the inner seal portion. The inner seal portion may be stronger than the outer seal portion due to by a higher temperature and/or pressure during seal formation. That is, the inner seal portion may be fused together more than the outer seal portion.

Figure 2A:
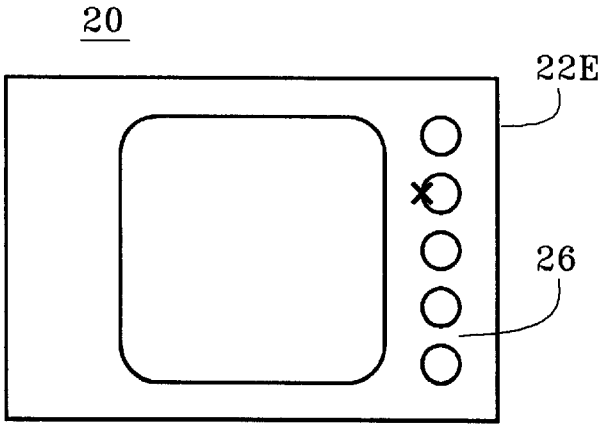
FIG. 2A is a side view of package 20 with a plurality of breaching bubbles 26.
Figure 2B:
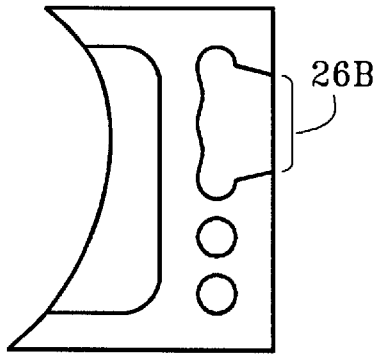
FIG. 2B is an end view of the package of FIG. 2A.

Plurality of Bubbles—(FIG. 2A and FIG. 2B)

The bubble-seal apparatus for opening the storage package may have a plurality of breaching bubbles within the band seal enclosed between the opposed laminae. The plurality of bubbles shown in storage package 20 of FIG. 2A and FIG. 1B form a straight line of adjacent bubbles 26. The consumer may apply breaching pressure to any single bubble, or several bubbles, or all of the bubbles. A bubble under applied pressure at point "X" expands towards package edge 22E, and also expands laterally towards adjacent the bubbles. The expanding bubble merges laterally with the adjacent bubbles, to provide a laterally expanded edge breach 26B with expanded peel flaps.

Figure 3:
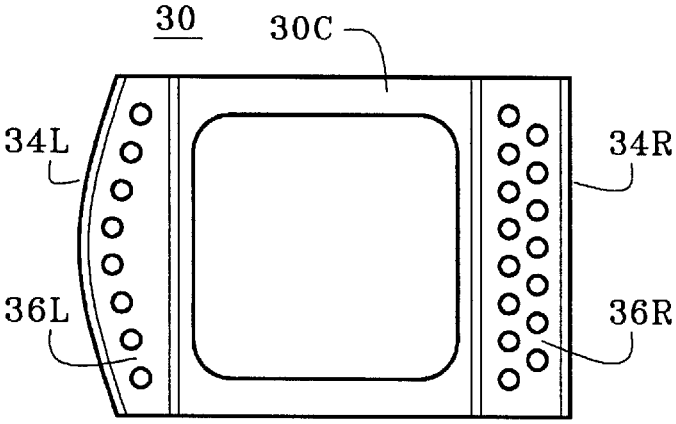
FIG. 3 is a side view of package 30 with two bubble arrays 36R and 36L defining two opening sites.

Multiple Openings—(FIG. 3)

A single storage package may have multiple bubble arrays for providing multiple openings into a single chamber or into multiple chambers. The multiple opening embodiment of FIG. 3 shows storage package 30 with a first opening site 34R along the right edge and a second opening site 34L along the left edge. The first opening site includes a right access region with a right band seal and right bubble array 36R, to provide a right opening into storage chamber 30C. The second opening site includes a left access region with a left band seal and left bubble array 36L, to provide a left opening into the chamber. Multiple opening sites offer the consumer multiple orientations to open. That is, two-site package 30 may be opened at either end. Further, if one bubble array fails to provide adequate peel flaps during breaching, the consumer may try another bubble array.

Bubble Configurations

Figure 4:
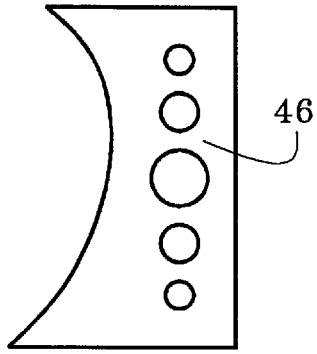
FIG. 4 is a fragmentary view of a package having different size bubbles in bubble array 46.
Figure 5:
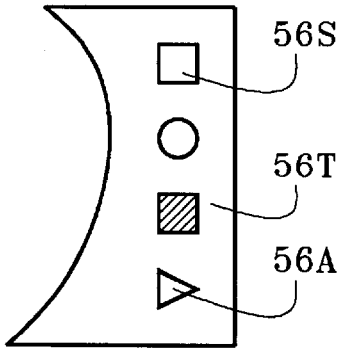
FIG. 5 is a fragmentary view of a package having different shaped bubbles.

The bubbles may be randomly arranged, or form an orderly array 36R or sequence 36L as shown in FIG. 3. The bubble sequence and package edge may be irregular or curved. The bubbles may all be the same size and shape, as shown the embodiment of FIG. 2 and FIG. 3. Such uniform bubble configurations create fewer manufacturing considerations. The bubbles may be different sizes. Bubble sequence 46 (see FIG. 4) has large and small bubbles. Large bubbles may facilitate opening the package, but may be at a higher risk of accidentally failing. Small bubbles provide smaller peel flaps, but may be more secure. The bubbles may be different shapes (see FIG. 5). The shape of the bubbles may indicate a particular application of the stored article. The shape (or shapes) of the bubbles may alert the user to a particular application or situation. For example, two critical applications in hospitals are sterility and controlled substances. Surgical gloves and supplies sealed in sterile packages may have one bubble shape such as square bubble 56S; while ordinary, non-sterile equipment may have another bubble shape such as arrow bubble 56A. Narcotics and other prescribed drugs sealed in tamper-proof packages may have a bubble shape easily distinguishable from over-the-counter medications. Further, different types of medications may have different shapes to help avoid confusion in dim lighting during the late shift. The hospital staff can feel (or see) the different shapes and determine the type of medication. Bubble 56A is arrow shaped pointing outward towards the edge of the package in the direction of expansion. The surface texture of a bubble may indicate a particular application of the stored article. A raised surface texture on textured bubble 56T may be impressed onto the bubble from a bubble shaping mold during manufacture. Alternatively the surface texture may be provided by other suitable techniques such as heat deformation, laser etching, and stick-on decals.

Audio/tactile Feedback

The bubble may provide a distinct breaching sound when an edge is breached indicating that the bubble has breached, and the outer seal has been opened by the expansion of the bubble. A sound inherently comes with bubble breaching. The breaching sound is caused by the rush of air under applied pressure escaping from the bubble through the edge breach during breaching. A large bubble may provide a solid popping sound similar to a small balloon popping. In contrast, small bubbles may just "peep" or whistle sound. A bubble may have a residual internal pressure greater than ambient external pressure to breach faster and provide a firmer bubble with a crisper breaching sound. Soft, spongy bubbles breach slower and make a flatter sound. An "odd" breaching sound, different from the usual sound, may indicate a failing or tampered seal.

Substance in Bubbles

The bubbles may contain a fluid (or fluid-like) substance which is displaced by the applied pressure to cause the bubble expansion. The bubble fluid may be any suitable gas such as an inert gas, or combination of gases, or just ambient air. Alternatively, the bubble fluid may be any suitable liquid such as water (or distilled water) or a substance such as a solvent or oil that cooperates with the stored article after opening. Bubble liquids are less compressible than bubble gases, and provide a firmer bubble. Alcohol may be employed as a bubble liquid. Alcohol remains a liquid at low temperatures which freeze the stored contents, permitting the package to be opened even though the contents are frozen solid. In contrast, bubble water may freeze along with the contents, dictating that the contents (and the bubble water) must be thawed before the bubbles may be edge breached and the package opened. The bubble fluid may contain an active ingredient which alters a visual characteristic of the fluid such as transparency or color when exposed to a contaminate. The contaminate may be an ambient contaminate from the external environment such as oxygen, which enters the bubble through a failed or leaky outer seal. Alternatively, the contaminate may be an internal contaminate given off by the article in the chamber, which enters the bubble through the inner seal. The bubble fluid may have a fragrance distinct from the external environment for indicating outward leakage through the outer seal. Further, the fluid may have a fragrance or flavor distinct from the stored article.

Large Embodiments

The storage package may be large, suitable for bulk transport, such as unloading from trucks or rescue drops of supplies from the air. Food, water, medicines, blankets and other essential supplies may be dropped to famine victims in remote locations and to water bound flood victims. The bubble-seal for this large embodiment may have large bubbles which may be edge breached by foot pressure and/or pressure from a heavy object such as a rock from the rescue site. The recipient places his boot on the bubble and steps down with his full weight to expand the bubble towards edge breach.

Conclusion

It will be apparent to those skilled in the art that the objects of this invention have been achieved as described hereinbefore by providing a bubble-seal apparatus for a package which permits easy opening by a consumer. The bubbles are edge breached by consumer applied pressure, which creates small initial peel flaps. By peeling back the flaps, the consumer may manually open the package using only his fingers, without tearing the tough closure material or employing a separate tool. Only light pressure on a single bubble or small groups of adjacent bubbles is required. Audio feedback is provided during the opening process by a rush of air escaping from the breaching bubbles. Tactile feedback is provided by the position and shape of the bubbles.

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

We claim:

1. A bubble seal apparatus for easily opening a storage package, comprising:

enclosure material forming a chamber within the package for containing a stored article;

chamber access region proximate the edge of the package;

band seal extending along the access region formed by opposed laminae of enclosure material pressed into sealing engagement;

a breaching bubble within the band seal enclosed between the opposed laminae;

an inner seal portion within the band seal between the bubble and the chamber, formed by the opposed laminae;

an outer seal portion within the band seal between the bubble and the edge of the apparatus, formed by the opposed laminae;

the bubble is expandable towards the edge of the apparatus by applied pressure separating the opposed laminae, until the bubble breaches at the edge creating an edge breach in the outer seal portion; and opposed peel flaps formed by the opposed laminae of the outer seal portion along the edge breach as the bubble breaches, which flaps are peeled apart separating the opposed laminae to open the band seal.

2. The bubble-seal apparatus of claim 1, further comprising opposed resealable engaging structure along the opposed lamina material forming the inner seal portion, to permit resealing the chamber after the band seal has been opened.

3. The bubble-seal apparatus of claim 1, further comprising:

a first edge of the apparatus with a first access region having a first band seal and a first bubble forming a first pair of flaps, to provide a first opening into the chamber; and a second edge of the apparatus with a second access region having a second band seal and a second bubble forming a second pair of flaps, to provide a second opening into the chamber.

4. The bubble-seal apparatus of claim 1, wherein the bubble provides a distinct breaching sound when edge breached indicating that the bubble has breached and the outer seal portion has been opened by the expansion of the bubble.

5. The bubble-seal apparatus of claim 4, wherein the bubble has a residual internal pressure greater than ambient external pressure to provide a firmer bubble with a crisper breaching sound.

6. The bubble-seal apparatus of claim 1, wherein the shape of the bubble indicates a particular application of the stored article.

7. The bubble-seal apparatus of claim 1, wherein the texture of the bubble indicates a particular application of the stored article.

8. The bubble-seal apparatus of claim 1, wherein the bubble is arrow shaped pointing in the direction of expansion outward towards the edge of the apparatus.

9. The bubble-seal apparatus of claim 1, wherein the bubble contains a fluid-like substance which may be displaced by the applied pressure.

10. The bubble-seal apparatus of claim 1, wherein the bubble contains a fluid which may be displaced by the applied pressure.

11. The bubble-seal apparatus of claim 10, wherein the bubble fluid is a gas.

12. The bubble-seal apparatus of claim 11, wherein the gas is ambient air.

13. The bubble-seal apparatus of claim 10, wherein the bubble fluid is a liquid.

14. The bubble-seal apparatus of claim 13, wherein the liquid is water.

15. The bubble-seal apparatus of claim 10, further comprising an active ingredient in the bubble fluid for altering a visual characteristic of the fluid when exposed to a contaminate.

16. The bubble-seal apparatus of claim 10, wherein the bubble fluid has a fragrance distinct from the external environment.

17. The bubble seal apparatus of claim 10, wherein the bubble fluid has a fragrance distinct from the stored article.

18. The bubble seal apparatus of claim 10, wherein the bubble fluid has a flavor distinct from the stored article.

19. The bubble-seal apparatus of claim 1, wherein the applied pressure is directed pressure urging the bubble expansion outward towards the edge of the apparatus.

20. The bubble-seal apparatus of claim 1, wherein the bubble expands under the applied pressure both outward towards the edge of the apparatus and laterally, to provide a laterally expanded edge breach with laterally expanded peel flaps.

21. The bubble-seal apparatus of claim 1, wherein the bubble expands under the applied pressure both outward towards the edge of the apparatus and inward towards the inner seal, to provide inward expanded peel flaps.

22. The bubble-seal apparatus of claim 1, further comprising an inward expansion stop formed in the inner seal portion, for hindering inward expansion of the bubble towards the inner seal portion and directing the bubble expansion outward under the applied pressure towards the edge of the apparatus.

23. The bubble-seal apparatus of claim 1, wherein the opposed peel flaps formed along the edge breach become enlarged in area as the flaps are peeled apart to include opposed lamina material forming the outer seal portion.

24. The bubble-seal apparatus of claim 1, wherein the opposed peel flaps formed along the edge breach become larger in area as the flaps are peeled apart to include opposed lamina material forming the outer seal portion and opposed lamina material forming the bubble.

25. The bubble-seal apparatus of claim 1, wherein the opposed peel flaps formed along the edge breach become larger in area as the flaps are peeled apart to include opposed lamina material forming the outer seal portion, and opposed lamina material forming the bubble, and opposed lamina material forming the inner seal portion.

26. The bubble-seal apparatus of claim 1, wherein the opposed lamina material forming the bubble and the outer seal portion stretches under the applied pressure and bubble expansion to provide looser peel flaps.

27. A storage package, comprising:

enclosure material forming a chamber within a package for containing a stored article;

chamber access region proximate the edge of the package;

band seal extending along the access region formed by opposed laminae of enclosure material pressed into sealing engagement;

a plurality of breaching bubbles within the band seal enclosed between the opposed laminae;

an inner seal portion within the band seal between the bubbles and the chamber, formed by the opposed laminae;

an outer seal portion within the band seal between the bubbles and the edge of the package, formed by the opposed laminae;

the bubbles are expandable towards the edge of the package by applied pressure progressively separating the opposed laminae, until breaching at the edge creating an edge breach in the outer seal portion; and opposed peel flaps formed by the opposed laminae of the outer seal portion along the edge breach during the bubble breaching, which flaps are peeled apart separating the opposed laminae to open the band seal.

28. The package of claim 27, wherein the bubbles form an array of bubbles.

29. The package of claim 27, wherein the bubbles form a sequence of bubbles.

30. The package of claim 27, wherein the bubbles form a line of adjacent bubbles.

31. The package of claim 27, wherein the bubbles are all the same size.

32. The package of claim 27, wherein the bubbles are different sizes.

33. The package of claim 27, wherein the bubbles have the same shape.

34. The package of claim 27, wherein the bubbles have different shapes.

35. The package of claim 27, wherein each bubble under applied pressure expands towards the edge and also expands laterally towards adjacent bubbles to laterally merge with adjacent bubbles, to provide a laterally expanded edge breach with expanded peel flaps.

* * * * *